US005718213A

United States Patent [19]

Gallops, Jr. et al.

[11] Patent Number: 5,718,213

[45] Date of Patent: Feb. 17, 1998

[54] SWING ARM CABLE GUARD

[75] Inventors: Henry M. Gallops, Jr.; Gary L. Simonds, both of Gainesville, Fla.

[73] Assignee: Bear Archery, Inc., Gainesville, Fla.

[21] Appl. No.: 591,719

[22] Filed: Jan. 25, 1996

[51] Int. Cl.[6] ..... F41B 5/10; F41B 5/14

[52] U.S. Cl. ..... 124/25.6; 124/86

[58] Field of Search ..... 124/24.1, 25.6, 124/86, 88

[56] References Cited

U.S. PATENT DOCUMENTS 4,207,858 6/1980 Blackstone ..... 124/88 X 4,834,061 5/1989 Chattin ..... 124/86

5,331,941 7/1994 Schaffer ..... 124/44.5

*Primary Examiner*—John A. Ricci

*Attorney, Agent, or Firm*—Malina & Wolson

[57] ABSTRACT

The improved cable guard of the present invention comprises a support member having a swing arm pivotally connected thereto at an angle. A cable retainer means having two bores therein for retaining the cables is pivotally mounted on the swing arm. The angle between the support member and swing arm is such that when the bow is drawn the distance between the cables, which are contained in the cable retaining means, and the plane of bowstring travel is less than the distance between the cables and that plane when the bow is at rest.

24 Claims, 8 Drawing Sheets

SWING ARM CABLE GUARD

This invention relates to compound archery bows and particularly to an improved cable guard for use thereon which maintains the required lateral spacing of the cables from the bowstring path of travel to permit free passage of an arrow, while reducing the friction on the cables and the stress on the bow limb.

BACKGROUND OF THE INVENTION

Cable guards are utilized in compound archery bows when the cables and bowstrings are too closely spaced laterally to permit the free passage of an arrow. Prior art cable guards are disclosed, for example, in U.S. Pat. No. 4,452,222, "Cable Guard for a Compound Bow", in U.S. patent application Ser. No. 08/509,377, "Inside Mounted Sliding Two-Piece Staggered Slots Cable Guard", and in U.S. Pat. No. 4,834,061, "Cable Vibraguard".

The cable guards disclosed in U.S. Pat. No. 4,452,222 and U.S. patent application Ser. No. 08/509,377 include retaining members which are slidably mounted on a round support rod. Each retaining member includes two bores which slidably receive the cable to hold them in laterally-spaced relationship with the bowstring.

It is known that contact of the moving cable within the bores of the cable retaining member creates frictional forces on the cable and attendant cable wear and can cause a distracting noise. The cable guard disclosed in the aforementioned patent application Ser. No. 08/509,377 reduces the contact force of the moving cable within the bores by providing discrete cable retaining means that are separately slidable on a cable rod. The cable retaining means are of different lengths and the cable rod is located within non-circular openings in the retaining means. In this manner, more freedom is present between the moving cable and the cable retaining member and less frictional force is developed. The present invention is directed to another means for lessening the frictional forces between the cables and the bores of the retaining means.

It is also known that it is desirable to minimize the lateral displacement of the cables with respect to the bow so as to minimize the stress and wear of the cables and minimize any tendency to twist the bow limbs. U.S. Pat. No. 4,452,222 discloses a cable guard rod having a first end portion connected to the handle and a second end portion offset from the first end portion by an integral intermediate portion at an acute angle to the end portions. The present invention is directed to an improved means for minimizing the lateral displacement of the cables with respect to the bow.

In prior art cable guards of the type described above, the rod on which the retaining members were slidably mounted was required to be of sufficient length to permit the retaining members to be mounted thereon when the bow was in the drawn condition. There are several disadvantages associated with a rod and sliding retainer system of this type. First, the rod length required can be a potential distraction to the archer when the arrow is being shot. Second, most archers do not remove the cable guard from their bow for transport, and since many forms of transportation require bows to be cased for transport, the use of such cable guards requires substantial storage area and larger bow cases. Third, the rod and sliding retainer introduces additional friction into the system, namely, the increased friction force between the cables and the sliding retainer and between the sliding retainer and the support rod as the bowstring is moved from brace position to full draw. Further, stiffer support rod means contribute to correspondingly increased frictional forces. Also, in such prior art cable guards, a certain amount of noise was generated by movement of the sliding retainer on the rod.

Some of these disadvantages appear to have been overcome by the cable guard disclosed in U.S. Pat. No. 4,834,061 wherein a support member has a swing arm pivotally attached thereto. A cable retaining member having two openings therein is located at the free end of the swing arm. The cables pass through and are contained within the openings of the retaining member. When the bow is drawn, the cables travel in a plane parallel to the general direction of the bowstring and cause the retaining member and connected swing arm to be pivoted away from the support member and the bow handle. The present invention is also an improvement of the cable guard disclosed in this patent.

SUMMARY OF THE INVENTION

The improved cable guard of the present invention comprises a support member having a swing arm pivotally connected thereto at an angle. A cable retaining means having two bores therein for retaining the cables, is pivotally mounted on the swing arm. The angle between the support member and swing arm is such that when the bow is drawn the distance between the cables which are contained in the cable retaining means, and the plane of bowstring travel is less than the distance between the cables and the plane of bowstring travel when the bow is at rest. As a result, and unlike previous cable guard arrangements, the cables and limbs are less stressed when the bow is at the draw position. Further, because the cable retaining means is pivotally mounted on the swing arm, there is more freedom and less friction between the cables and the cable retaining means.

It is an object of the present invention to provide an improved cable guide in which the cables are positioned closer to the plane of the bowstring when the bow is drawn than when the bow is at rest, thereby creating less stress on the cables and the bow limbs when the bow is drawn.

It is an object of the present invention to provide an improved cable guide in which the frictional forces generated between the cables and the cable retaining members are reduced when the bow is drawn.

Other objects and attendant advantages of this invention will be readily appreciated as the same become better understood by references to the following detailed description when considered in connection with the accompanying drawings in which like reference numerals designate like parts throughout the figures thereof.

A better understanding of the present invention will be had with reference to the following detailed description when read in conjunction with the accompanying drawings wherein like reference characters designate like parts throughout the figures thereof.

DESCRIPTION OF A PREFERRED EMBODIMENT OF THE INVENTION

Figure 1:
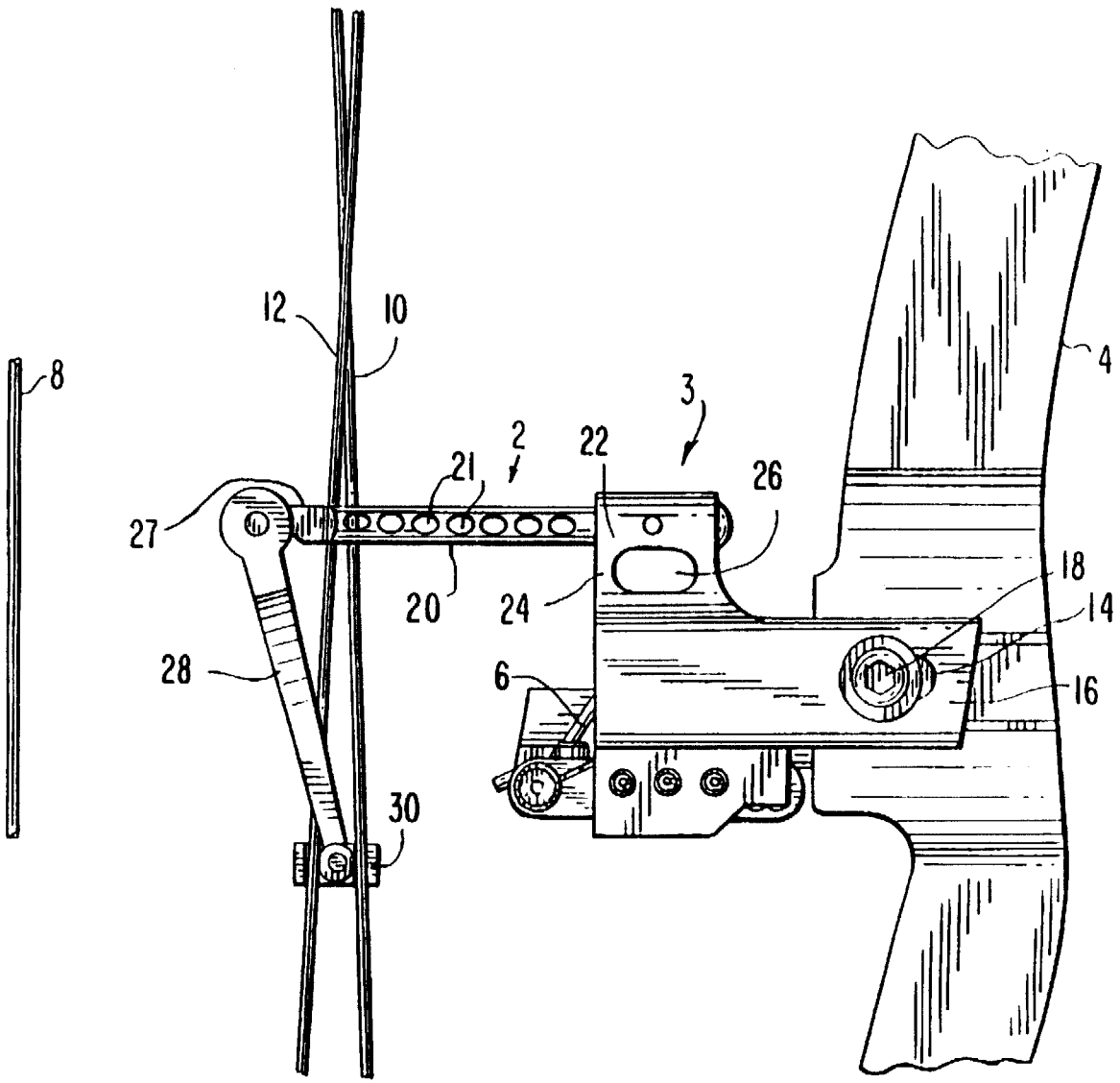
FIG. 1 is a side elevation view of a first embodiment of the improved swing arm cable guard of the present invention attached to an overdraw mounted on an archery bow handle and wherein the archery bow is in the brace position.
Figure 2:
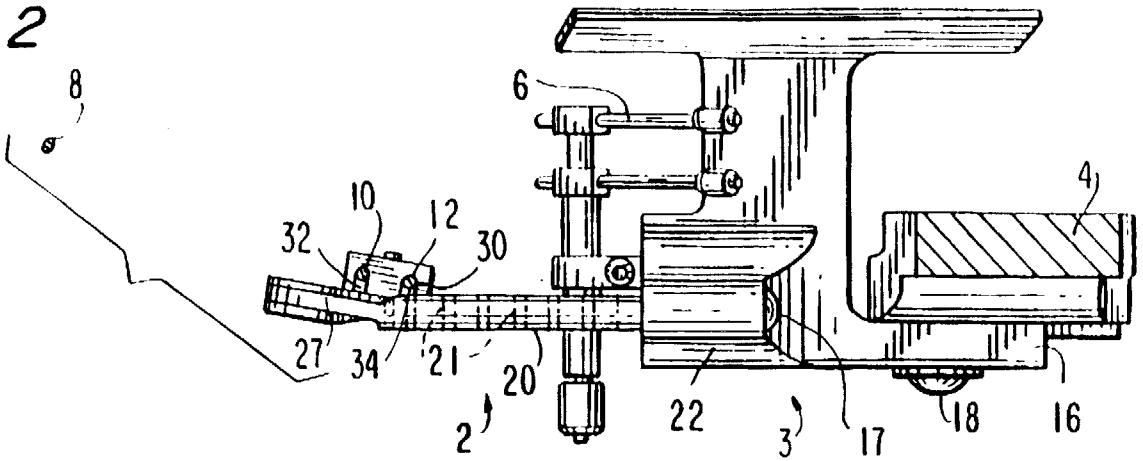
FIG. 2 is a top view of the improved swing arm cable guard shown in FIG. 1 wherein the archery bow is in the brace position.
Figure 3:
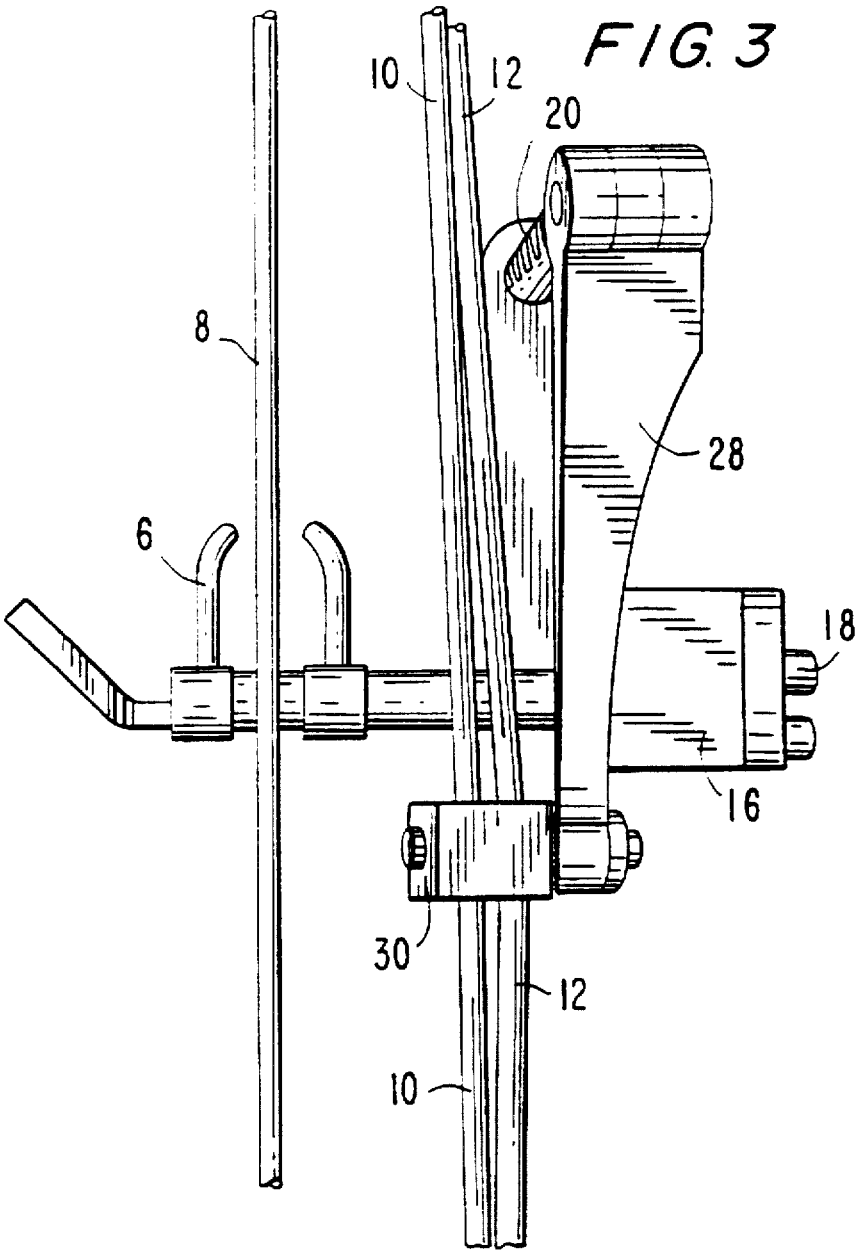
FIG. 3 is an elevation view of the improved swing arm cable guard shown in FIG. 1.

There is shown in FIG. 1 a first embodiment of an improved swing arm cable guard 2 which is adapted for mounting in the rear of an overdraw bracket 3 which, in turn, is mounted on the outer face of a compound archery bow handle 4. A conventional arrow rest 6 shown in FIG. 2 is mounted on the overdraw 3. A bowstring 8 and cables 10 and 12 of a compound bow are shown in their position relative to each other and to the handle 4 when the bow is in the brace position. The cables 10 and 12 and bowstring 8 of a conventional compound bow extend over eccentric wheels or pulleys (not shown) attached to the outer ends of the bow limbs. The cables 10 and 12 are spaced laterally from the bowstring 8 as seen, for example, in FIG. 3.

The overdraw bracket assembly 3 includes an opening 14 in a rear section 16. A capscrew 18 inserted in opening 14 of overdraw bracket 3 and in an opening in archery bow handle 4 connects overdraw bracket 3 to archery bow handle 4. The opening 14 of overdraw bracket 3 allows the overdraw bracket 3 to be moved perpendicularly with respect to the handle 4 for adjustment of the arrow rest 6 with respect to the handle 4.

Figure 2A:
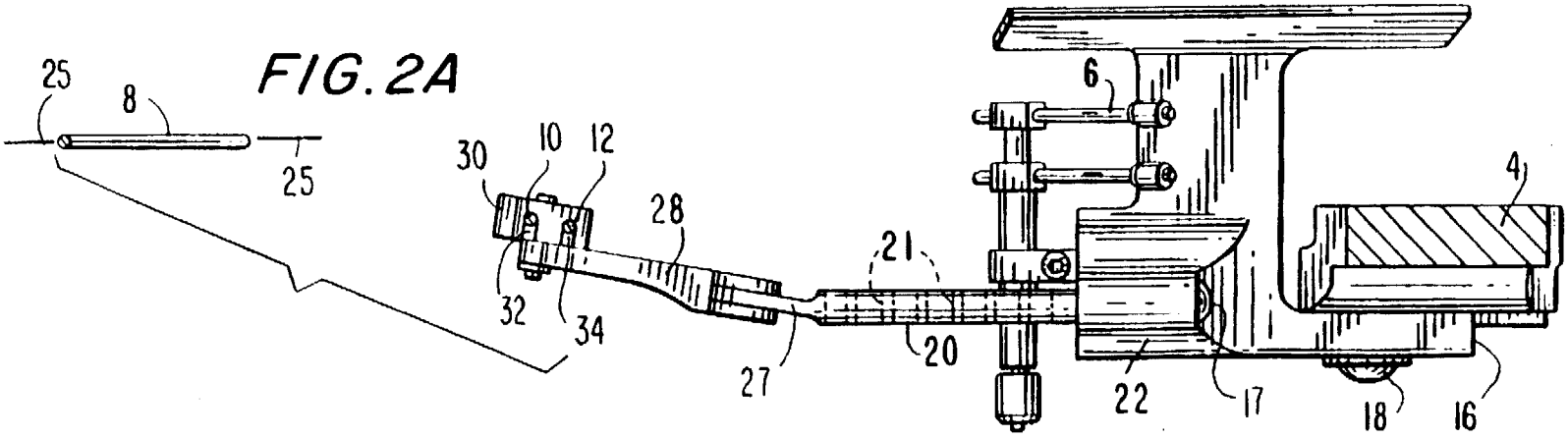
FIG. 2A is a top view of the improved swing arm cable guard wherein the archery bow is in the drawn position.

The cable guard 2 includes a support arm 20, including openings 21 therein for weight reduction purposes. Support arm 20 extends rearward from a top section 22 of overdraw bracket 3 and is perpendicular to the axis of the bowstring 8 at brace and to the vertical axis of the archery bow handle 4. As best seen in FIG. 2 and FIG. 2A, the pivot end 27 of the support arm 20 is angled inward in the direction of the bowstring 8. The support arm 20 is attached to overdraw bracket 3 by capscrew 17. The overdraw bracket 3 includes side sections 24 having an opening 26 therein for weight reduction purposes. A swing arm 28 is pivotally connected to support arm 20 at pivot end 27. A cable retaining means 30 having openings 32 and 34 therein which retain cables 10 and 12 is pivotally connected to the other end of swing arm 28.

Figure 1A:
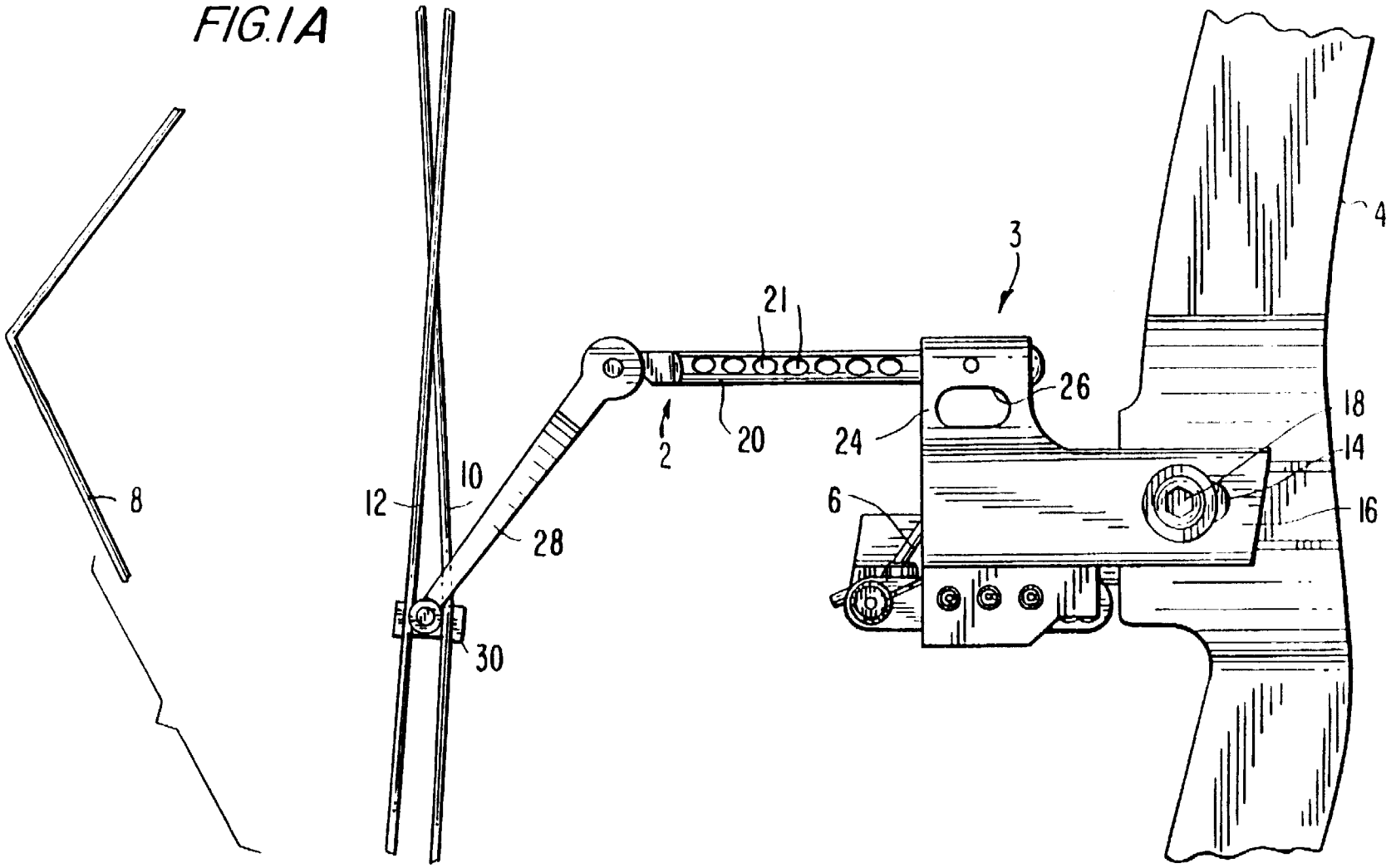
FIG. 1A is a side elevation view of the improved swing arm cable guard shown in FIG. 1 and wherein the archery bow is in the drawn position.

The operation of the first embodiment of the improved cable guard of the present invention is best seen in FIG. 1 wherein the bow is in the brace position, and FIG. 1A wherein the bow is in the drawn position. It will be seen that when bowstring 8 is drawn, cables 10 and 12 move in the direction of the bowstring and both cable retaining means 30 and swing arm 28 are caused to be pivoted clockwise to the position shown in FIG. 1A. Because, as seen in FIG. 2 and FIG. 2A, the cable retaining means 30 moves closer to the plane of the bowstring travel 25 as the bowstring 8 is drawn, the normal forces of the cables 10 and 12 against openings 32 and 34 of retaining means 30, and the attendant frictional forces generated thereby, are reduced. In addition, because cables 10 and 12 are closer to the bowstring 8, there is less torque on the bow limbs in comparison to the condition wherein the retainer means moves in a plane parallel to the travel of the bowstring. Also, because the retaining means 30 is pivotally mounted on the swing arm 28, there is greater freedom and reduced frictional forces between the cables 10 and 12 and retaining means 30.

Figure 4:
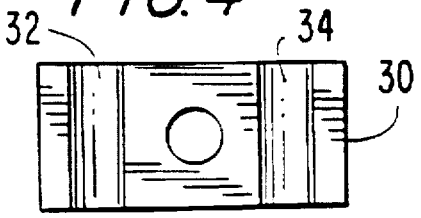
FIG. 4 is an exploded elevation view of the cable retaining means of the improved swing arm cable guard.
Figure 5:
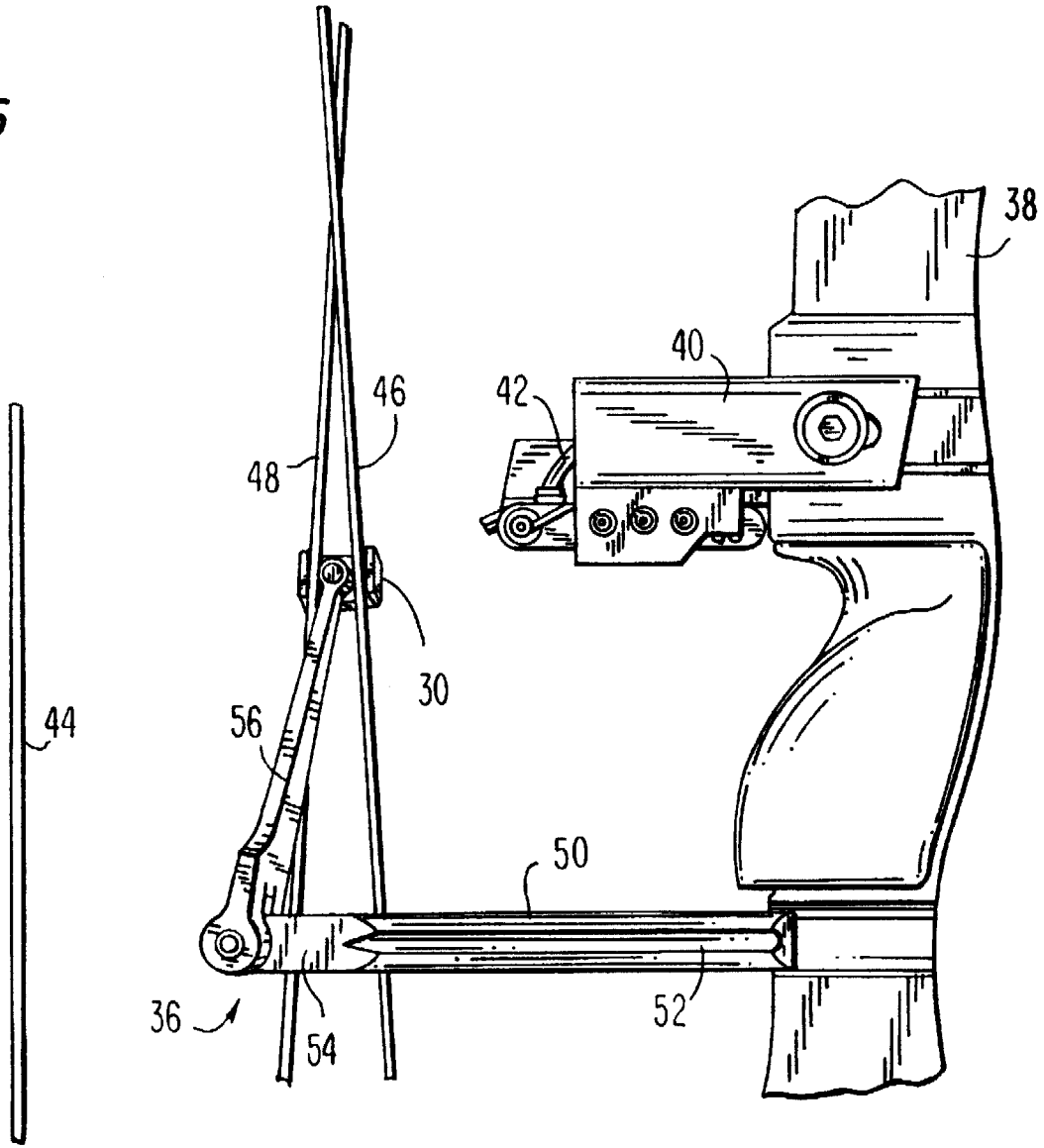
FIG. 5 is a side elevation view of a second embodiment of the improved swing arm cable guard of the present invention mounted to an archery bow handle and wherein the archery bow is in the brace position.
Figure 5A:
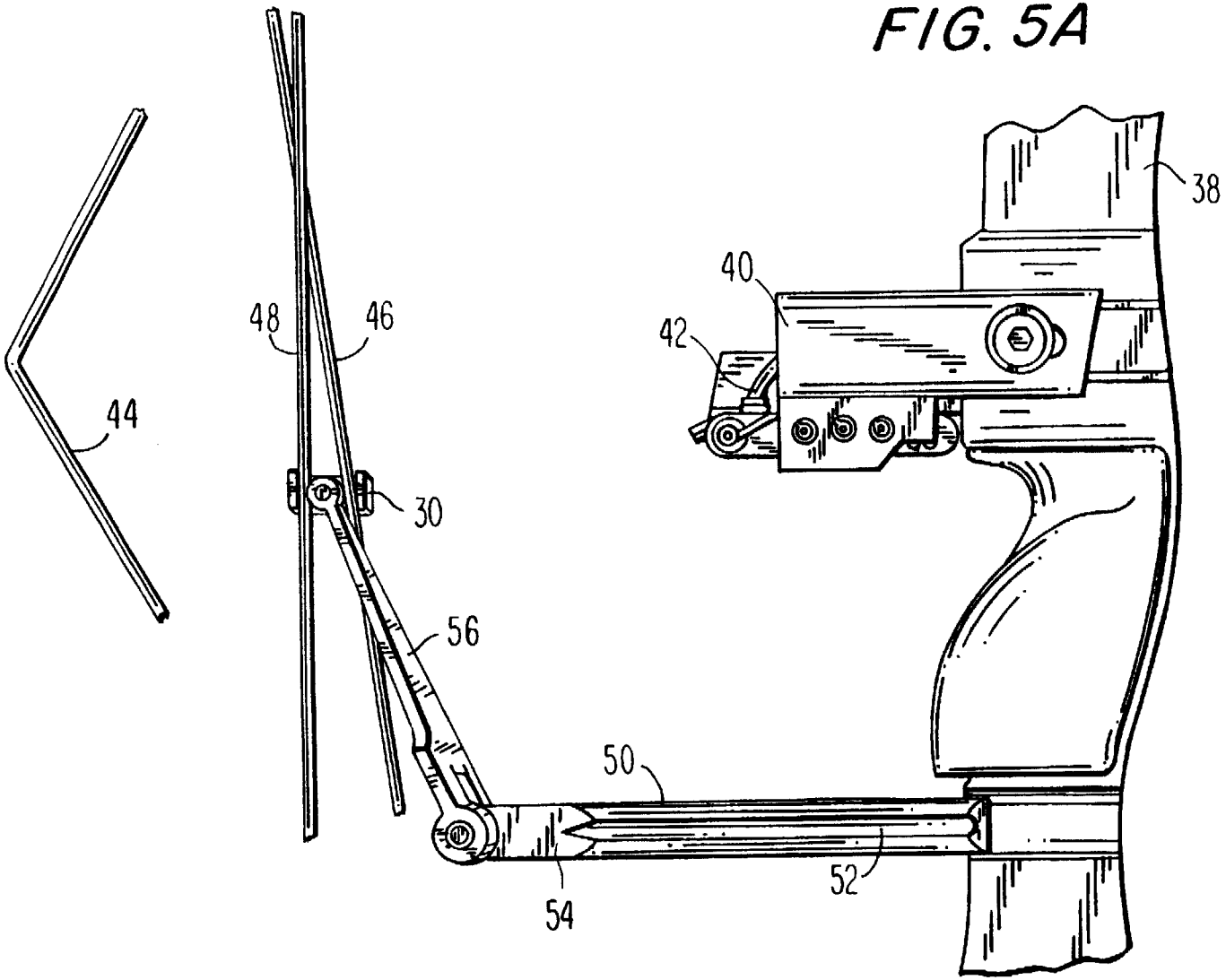
FIG. 5A is a side elevation view of the improved swing arm cable guard shown in FIG. 5 and wherein the archery bow is in the drawn position.

There is shown in FIG. 5 a second embodiment of an improved swing arm cable guard 36, which is adapted for mounting directly to the inner face of a compound bow handle 38 and in this manner the cable guard functions independently of any overdraw bracket 40 or arrow rest 42 system. The overdraw 40 and arrow rest 42 is identical to the overdraw bracket 3 and arrow rest 6 shown in FIG. 1. A bowstring 44 and cables 46 and 48 are shown in their position relative to each other and to the handle 38 when the bow is in the brace position. The cables 46 and 48 and bowstring 44 of a conventional compound bow extend over eccentric wheels or pulleys (not shown) attached to the outer ends of the respective bow limbs. The cables 46 and 48 are spaced laterally from the bowstring 48 as seen, for example, in FIG. 7. The cable guard 36 includes a support arm 50 which is secured to bow handle 38 with capscrew 51 (see FIG. 7) in such a manner that when capscrew 51 is tight, the support arm 50 is not capable of rotation about the principal axis of capscrew 51. A first end 52 of support arm 50 extends away from the bow handle 38 in a direction angling away from the plane of bowstring 44. A second end 54 of support arm 50 extends away from the bow handle 38 in a direction angling toward the plane of the bowstring 44 (FIG. 6A) and perpendicular to the vertical axis of the archery bow handle 38 (FIG. 5A). Support arm 50 is spaced laterally from the bowstring 44 and cables 46 and 48. A swing arm 56 is connected to the second end 54 at one end and carries a cable retaining means 30 at the other end. Cable retaining means 30 includes openings 32 and 34 (FIG. 4) which retains cables 46 and 48.

Figure 6:
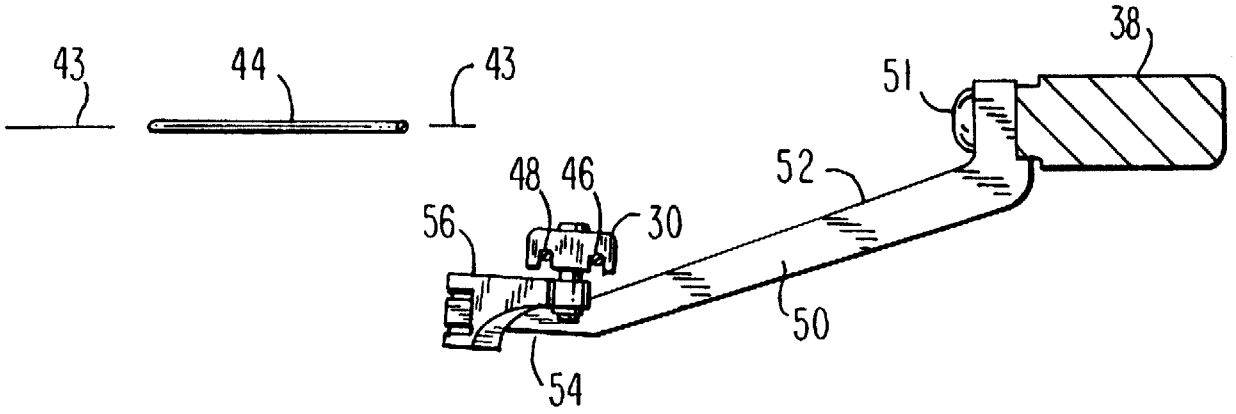
FIG. 6 is a top view of the improved swing arm cable guard shown in FIG. 5 and wherein the archery bow is in the brace position.
Figure 6A:
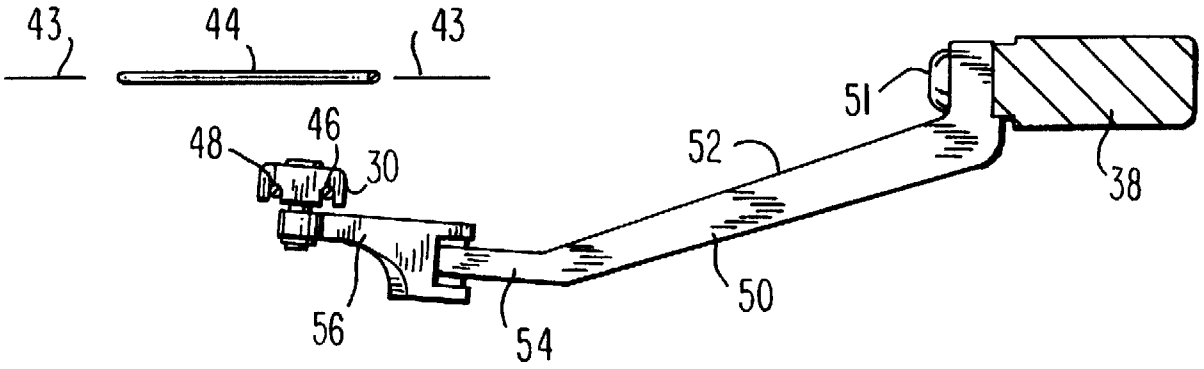
FIG. 6A is a top view of the improved swing arm cable guard shown in FIG. 5A, wherein the archery bow is in the drawn position.
Figure 7:
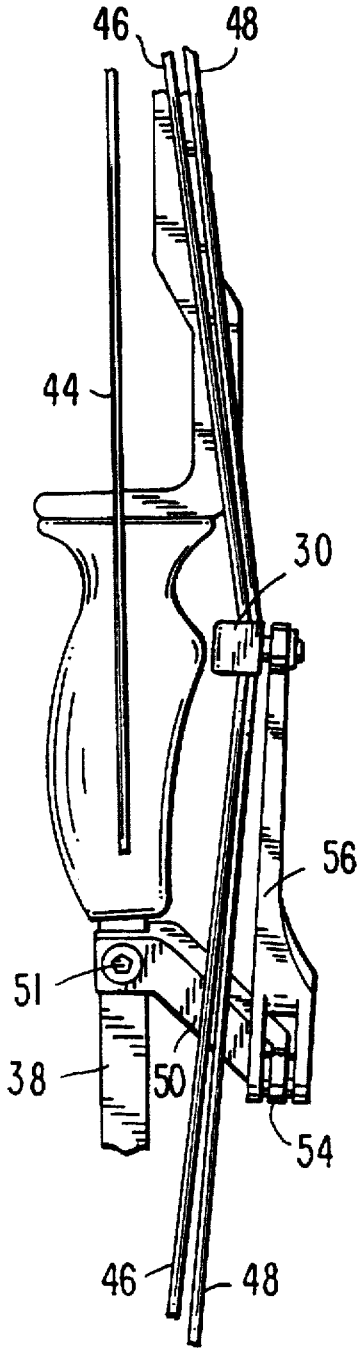
FIG. 7 is an elevation view of the improved swing arm cable guard shown in FIG. 5.

The operation of the second embodiment of the improved cable guard of the present invention is best seen in FIG. 5 wherein the bow is in the brace position, and FIG. 5A wherein the bow is in the drawn position. It will be seen that when bowstring 44 is drawn, cables 46 and 48 move in the direction of the bowstring 44 and both cable retaining means 30 and swing arm 56 are caused to be pivoted counterclockwise to the position shown in FIG. 5A. Because, as seen in FIG. 6 and FIG. 6A, the cable retaining means 30 moves closer to the plane of the bowstring travel 43 when the bowstring 44 is drawn, the normal forces of the cables 46 and 48 against openings 32 and 34 of retaining means 30, and the attendant frictional forces generated thereby, are reduced as compared to the prior art. In addition, because cables 46 and 48 are closer to the bowstring 44, there is less torque on the bow limbs. Also, because the retaining means 30 is pivotally mounted on the swing arm 56, there is greater freedom and reduced frictional forces between the cables 46 and 48 and retaining means 30.

Having thus described the invention, it will be apparent to those skilled in the art that various modifications can be made within the scope of the invention. It is therefore understood that the present invention may be practiced otherwise than as specifically described.

We claim:

1. An improved swing arm cable guard for use with a compound bow having a handle, an overdraw bracket mounted on the handle, a pair of bow limbs, at least one feed cam, a bowstring, at least one return cable, and cable retaining means for retaining said at least one return cable away from said bowstring to provide a clear flight path for the arrow, said improved swing arm cable guard comprising:

a support arm affixed at a first end to the overdraw bracket and having a second end angled inward in the direction of the bowstring;

a swing arm pivotally connected at a first end to the second end of said support arm; and means for pivotally connecting the cable retaining means to a second end of said swing arm.

2. An improved swing arm cable guard as recited in claim 1, wherein said swing arm, having the cable retaining means thereon, is angled inward in the direction of the bowstring, so that when the bow is drawn, the cable retaining means is closer to the bowstring plane of travel than when the bow is in the brace position.

3. An improved swing arm cable guard as recited in claim 1, wherein said support arm extends rearwardly from the bow and beyond the return cable when the bow is in the brace position and wherein said return cable extends beyond the support arm when the bow is in the drawn position.

4. An improved swing arm cable guard as recited in claim 1, wherein the support arm is in a plane perpendicular to the plane of the handle.

5. An improved swing arm cable guard as recited in claim 1, wherein the support arm is affixed to the top of the overdraw bracket.

6. An improved swing arm cable guard for use with a compound bow having a handle, an overdraw bracket mounted on the handle, a pair of bow limbs, at least one feed cam, a bowstring and at least one return cable, said improved swing arm cable guard comprising:

a support arm affixed at a first end to the overdraw bracket and having a second end angled inward in the direction of the bowstring;

a swing arm pivotally connected at a first end to the second end of said support arm;

cable retaining means mounted on a second end of said swing arm; and wherein said swing arm, having the cable retaining means thereon, being angled inward in the direction of the bowstring so that when the bow is drawn, the cable retaining means is closer to the bowstring plane of travel than when the bow is in the brace position.

7. An improved swing arm cable guard as recited in claim 6 including means for pivotally connecting the cable retaining means to a second end of said swing arm.

8. An improved swing arm cable guard as recited in claim 6, wherein said support arm extends rearwardly from the bow and beyond the return cable when the bow is in the brace position and wherein said return cable extends beyond the support arm when the bow is in the drawn position.

9. An improved swing arm cable guard as recited in claim 6, wherein the support arm is in a plane perpendicular to the plane of the handle.

10. An improved swing arm cable guard as recited in claim 6, wherein the support arm is affixed to the top of the overdraw bracket.

11. An improved swing arm cable guard for use with a compound bow having a handle, a pair of bow limbs, at least one feed cam, a bowstring, at least one return cable, and cable retaining means for retaining said at least one return cable away from said bowstring to provide a clear flight path for the arrow, said improved swing arm cable guard comprising:

a support arm affixed at a first end to the handle and angled away from the handle;

a swing arm pivotally connected at a first end to the second end of said support arm; and means for pivotally connecting the cable retaining means to a second end of said swing arm.

12. An improved swing arm cable guard as recited in claim 11, wherein said swing arm is angled inward in the direction of the bowstring, so that when the bow is drawn, the cable retaining means is closer to the bowstring plane of travel than when the bow is in the brace position.

13. An improved swing arm cable guard as recited in claim 12, wherein the support arm is angled away from the plane of bowstring travel.

14. An improved swing arm cable guard as recited in claim 11, wherein said support arm extends rearwardly from the bow and beyond the return cable when the bow is in the brace position and wherein said return cable extends beyond the support arm when the bow is in the drawn position.

15. An improved swing arm cable guard as recited in claim 11, wherein the support arm is angled away from the plane of bowstring travel.

16. An improved swing arm cable guard as recited in claim 11, wherein the support arm is affixed to the handle below the arrow rest mounting point.

17. An improved swing arm cable guard as recited in claim 11, wherein the support arm is affixed to the handle above the arrow rest mounting point.

18. An improved swing arm cable guard for use with a compound bow having a handle, a pair of bow limbs, at least one feed cam, a bowstring and at least one return cable, said improved swing arm cable guard comprising:

a support arm affixed at a first end to the handle and angled away from the handle;

a swing arm pivotally connected at a first end to the second end of said support arm;

cable retaining means mounted on a second end of said swing arm; and wherein said swing arm, having the cable retaining means thereon, is angled inward in the direction of the bowstring so that when the bow is drawn, the cable retaining means is closer to the bowstring plane of travel than when the bow is in the brace position.

19. An improved swing arm cable guard as recited in claim 18, including means for pivotally connecting the cable retaining means to a second end of said swing arm.

20. An improved swing arm cable guard as recited in claim 19, wherein the support arm is angled away from the bowstring.

21. An improved swing arm cable guard as recited in claim 18, wherein said support arm extends rearwardly from the bow and beyond the return cable when the bow is in the brace position and wherein said return cable extends beyond the support arm when the bow is in the drawn position.

22. An improved swing arm cable guard as recited in claim 18 wherein the support arm is angled away from the bowstring.

23. An improved swing arm cable guard as recited in claim 18, wherein the support arm is affixed to the handle below the arrow rest mounting point.

24. An improved swing arm cable guard as recited in claim 18, wherein the support arm is affixed to the handle above the arrow rest mounting point.

* * * * *